US005435927A

United States Patent [19]

Beckwith et al.

[11] Patent Number: 5,435,927

[45] Date of Patent: Jul. 25, 1995

[54] LUBRICATING OIL COMPOSITION

[75] Inventors: Paul Beckwith, Guildford; Ian C. Callaghan, Wokingham; David Masheder, Camberley, all of United Kingdom

[73] Assignee: The British Petroleum Company p.l.c., London, England

[21] Appl. No.: 146,185

[22] PCT Filed: Mar. 15, 1993

[86] PCT No.: PCT/GB93/00530

§ 371 Date: Dec. 2, 1993

§ 102(e) Date: Dec. 2, 1993

[87] PCT Pub. No.: WO93/19142

PCT Pub. Date: Sep. 30, 1993

[30] Foreign Application Priority Data

Mar. 16, 1992 [GB] United Kingdom ..... 9205726

[51] Int. Cl.[6] ..... C10M 131/10; C10M 131/12

[52] U.S. Cl. ..... 252/54; 252/54.6

[58] Field of Search ..... 252/54, 54.6

[56] References Cited

U.S. PATENT DOCUMENTS

| | | | |
|---|---|---|---|
| 3,250,808 | 5/1966 | Phillip et al. . | |
| 3,696,128 | 10/1972 | Garth | 252/54.6 X |
| 5,034,525 | 7/1991 | Dekura | 252/54 X |
| 5,066,412 | 11/1991 | Migdal et al. . | |
| 5,169,548 | 12/1992 | Strepparola et al. | 252/54 X |
| 5,190,681 | 3/1993 | Strepparola et al. | 252/54 X |
| 5,221,494 | 6/1993 | Ikeda | 252/54 X |

FOREIGN PATENT DOCUMENTS

| | | |
|---|---|---|
| 0432273A1 | 6/1991 | European Pat. Off. . |
| 0475393A1 | 3/1992 | European Pat. Off. . |
| 0488273A1 | 6/1992 | European Pat. Off. . |

*Primary Examiner*—Prince Willis, Jr.
*Assistant Examiner*—Cephia D. Toomer
*Attorney, Agent, or Firm*—Nixon & Vanderhye

[57] ABSTRACT

A lubricating oil composition for use in an internal combustion engine comprising (1) a lubricating base oil, and (2) a monofunctional perfluoropolyether derivative of the general formula $R_F$-Z where $R_F$ is a perfluoropolyether moiety with an average molecular weight in the range of from 135 to 20,000, and Z is a functional group.

8 Claims, No Drawings

LUBRICATING OIL COMPOSITION

This application is a 371 of PCT/GB93/00530 filed on 15 Mar. 1993.

The present invention relates to the reduction of the emission of undesirable materials such as unburnt hydrocarbons from internal combustion engines.

The emission of unburnt hydrocarbons from internal combustion engines is increasingly considered to be undesirable. Apart from any harmful effects of the hydrocarbons themselves they may react with other atmospheric pollutants and contribute to the formation of increased levels of atmospheric ozone, and photochemical smog.

One source of unburnt hydrocarbons in exhaust emissions involves the lubricating oil used in the engine. Most internal combustion engines make use of a piston reciprocating in a cylinder with a combustion chamber at one end. Movement of the piston within the cylinder is lubricated by a film of lubricating oil which is supplied to the cylinder on the side remote from the combustion chamber. Piston rings are provided to control oil thickness on the cylinder wall. However, fuel can be absorbed into the oil film during induction and compression and this can be desorbed after combustion and be emitted as unburnt hydrocarbons. Furthermore, evaporating lubricating oil can be responsible for undesirable emissions from internal combustion engines.

It would be desirable to find a way of reducing emissions in which lubricating oil is involved.

Accordingly the present invention provides a lubricating oil composition for use in an internal combustion engine comprising (1) A lubricating base oil, and (2) a monofunctionalized perfluoropolyether derivative of general formula $$R_F\text{-}Z$$

when $R_F$ is a perfluoropolyether moiety with average molecular weight in the range of from 135 to 20,000, and Z is a functional group.

The base oil may be a conventional hydrocarbon base oil prepared by solvent extraction of fractions produced in the refining of crude oil. It may also be a synthetic hydrocarbon base oil produced by polymerisation. Alternatively, it may include a synthetic ester base oil. For the purposes of the present invention, a base oil contains a conventional multifunctional additive package.

The group $R_F$ is a perfluoropolyether moiety. In this specification "perfluorinated" is to be understood as corresponding to compounds in which the major part of any hydrogen atoms are replaced by fluorine atoms, e.g. more than 70% of the hydrogen atoms are replaced by fluorine atoms. It is believed that the best results will be obtained with compounds which are completely fluorinated.

The perfluoropolyether moiety preferably has an average molecular weight in the range of from 250 to 7000, especially from 400 to 2500 as explained below.

The perfluoropolyether moiety $R_F$ consists of a chain of perfluoroalkoxy groups terminated at one end with a perfluoroalkyl group e.g. a $CX_2$ group, where each of X is separately F or $CF_3$. Preferably $CX_2$ is —$CF(CF_3)$ or $CF_2$, more preferably $CF_2$. The perfluoroalkoxy group may suitably be perfluoromethoxy —$(CF_2O)$—, perfluoroethoxy —$(CF_2—CF_2—O)$— or perfluoropropoxy —$(CF_2CF(CF_3)O)$—. The perfluoropolyether chain may comprise one of the aforementioned perfluoroalkoxy groups or a combination thereof. Where it is desired to have two or more different groups, suitably the chain comprises a mixture of either (a) perfluoropropoxy and perfluoromethoxy, or (b) perfluoroethoxy and perfluoromethoxy groups. The ratio of the two alkoxy groups in the chain may suitably be in the range of from 20:1 to 1:20, preferably 5:1 to 1:5.

The functional group Z may suitably be a carboxylic acid or a carboxylate salt group. Alternatively, Z may be an ester, an amide, a hydroxy, a hydroxy methyl, an alkoxy, an alkoxy methyl or a polyol ether functionality.

Where Z is an ester functionality, Z may be derived from a poly(alkylene oxide) such as polyalkylene glycol, a polyalkylene alcohol such as polyisobutene alcohol, or a polyol such as polyvinyl alcohol. Z may also be derived from an alcohol such as octanol. The poly(alkylene oxide) may have a terminal hydroxy group.

Where Z is an amide functionality, Z may suitably be derived from the aforementioned poly(alkylene oxide), polyalkylene and polyol compounds having a terminal amine group. Z may also be derived from a primary or secondary amine, e.g. octylamine.

It is preferred that $R_F$-Z is obtained from an ester of a monofunctional perfluoropolyether carboxylic acid and a hydroxy terminated monofunctional polyalkylene glycol. The acid component of the ester consists of a perfluoropolyether chain terminated at one end by a perfluoroalkoxy group and at the other end by a —$CF_2COO$— group.

Where $R_F$-Z of the present invention is a perfluoropolyether ester, these may be made as disclosed in our copending European patent application 92308961.9 (BP Case 7625). As disclosed in the above-identified application, the ester may be made by reacting the acid and hydroxy components using conventional esterification techniques, for example. using the acid chloride as an intermediate and employing non-aqueous conditions.

The perfluoropolyether carboxylic acid used to make the polyester suitably has an average molecular weight in the range of from 180 to 7000, preferably from 445 to 2545. As explained in the above-mentioned application the hydroxy terminated poly(alkylene oxide) and the acid are normally produced as mixtures containing molecules with a range of molecular weights with the proportion having a given molecular weight being distributed on either side of a maximum or peak value. The molecular weight and distribution may be measured by laser desorption ion cyclotron resonance mass spectrometry. The molecular weight corresponding to the peak of the signal is the average (mode) molecular weight.

The hydroxy or amine terminated component suitably has an average molecular weight in the range 31 to 3500, preferably 50 to 2000. Where it is desired to use a poly(alkylene oxide) to prepare the perfluoropolyether ester, it may be made by reaction of alkylene oxide with a starter molecule such as methanol, ethanol or butanol.

The lubricating oil composition can be prepared by mixing the base oil with the perfluoropolyether additive, and any other additives, by conventional methods.

The amount of perfluoropolyether derivative present in the lubricating oil composition may, for example, be in the range 50 to 5000 ppm, preferably 100 to 1500 ppm based on total weight of lubricant.

The lubricating oil composition of the present invention is particularly suitable for use with spark ignition engines using a gasoline fuel.

The invention will now be described with reference to the following examples.

EXAMPLE 1

A perfluoropolyether ester was prepared as follows.

Perfluoropolyether carboxylic acid (30 g) commercially available as "Galden" mono-acid was introduced into a reaction vessel. The acid was a mono-functional carboxylic acid with the carboxylic acid group attached to a perfluoropolyether chain. The average molecular weight was determined by laser desorption ion cyclotron resonance mass spectroscopy to be about 1100.

Phosphorus pentachloride was added at room temperature (ca 20° C.) to the perfluoro acid until gas evolution ceased. The amount of phosphorus pentachloride added was 7.6 g. The by-products (phosphorus oxychloride, HCl) were removed by evaporation to leave the acid chloride.

Poly(ethylene glycol) monomethyl ether (2.0 g) from a commercial source and sold as having an average molecular weight of 350 (PEG 350) was added to the acid chloride (6.62 g) at room temperature. The peak molecular weight of the PEG 350 was determined to be about 384.

The reaction mixture was initially milky, but quickly cleared on standing. HCl produced as a by-product was removed by applying reduced pressure.

The resulting product had an infrared absorption band at 1790cm$^{-1}$ NMR spectroscopy showed that the reaction product was a mixture of the required ester and a small amount (25%) of unreacted poly(ethylene glycol) monomethyl ether.

Example 1a; Engine Test

The ester prepared as above was blended into a SAE 30 monograde crankcase oil to give an ester content of 200 ppm based on weight of oil. This was a conventional hydrocarbon base oil prepared by standard solvent extraction techniques and contained additives conventionally used in crankcase oils.

The lubricating oil treated with the novel additive was evaluated in single cylinder engine tests, back to back with the untreated lubricating oil. The test method used was a screening test devised to simulated the emissions performance, in terms of unburnt hydrocarbon (HC), of a modern vehicle fitted with a catalytic converter, when driven over the ECE 15.04+EUDC drive cycle. The tests were carried out at an engine speed of 1500 rpm, with the engine oil, coolant and intake air all controlled to a constant temperature of 30 degrees C. This test was chosen because the majority of HC emissions from catalyst vehicles occur during the early stages of operation, before the vehicle has warmed up. The fuel used for this work was a conventional gasoline containing 40% aromatics by volume. Emissions were measured (including HC by conventional flame ionisation detector) over a range of engine load conditions, from idle to three quarters throttle.

EXAMPLE 2

An experiment was carried out as in Example 1 except that the quantity of perfluoropolyether ester added to the lubricating oil was 800 ppm instead of 200 ppm.

Comparative Test A

An engine test was carried out as in Example 1a except that the lube oil contained no perfluoropolyether ester.

A comparison of the results for Comparative Test A with those for Examples 1 and 2 showed that a reduction in hydrocarbon emissions of between 100 to 150 ppm (methane equivalent) was found using 200 ppm of additive in Example 1, while a reduction of 150 to 200 ppm in hydrocarbon emissions was found using 800 ppm of additive in Example 2.

The emission reduction obtained in Examples 1 and 2 is a reduction of between 5 and 10% of the total hydrocarbon emission.

EXAMPLE 3

An engine test was carried out as in Example 1. However, instead of using a perfluoropolyether ester at a dosage of 200 ppm in the lubricating oil, a perfluoropolyether alcohol was used at a dosage rate of 1100 ppm based on weight of lubricating oil. The perfluoropolyether alcohol was a commercially available product available under the trade name "Galden" alcohol.

The alcohol corresponded to the formula $$CF_3O(CF_2CF(CF_3)O)_m(CF_2O)_n CF_2CH_2OH$$

with a ratio of m:n of 1:20 and a molecular weight of about 700.

Reduction in hydrocarbon emissions was obtained using the alcohol, varying between 50 and 150 ppm (methane equivalent).

EXAMPLE 4

A mixture of perfluoropolyether carboxylic acid (56.5 g) commercially available as "Calden" mono-acid, corresponding to the formula $$CF_3O(CF(CF_3)CF_2O)_{2.6}(CF_2O)_{2.8}CF_2COOH$$

and a poly(alkylene oxide) alcohol in the mass ratios as detailed in Table 1 and benzene (75 ml) were placed in a 500 ml round bottomed flask, equipped with a Dean and Stark water separation unit carrying an efficient reflux condenser at its upper end. The mixture was refluxed using a magnetic stirrer/hot plate unit until no more water collected in the water separator. The benzene was removed by evaporation under reduced pressure. NMR and IR spectroscopy confirmed that the reaction product was the required ester.

The resulting esters were blended into the crankcase oil as described in Example 1*a* above and the resulting compositions used to lubricate a test engine, again as described in Example 1a except that the lubricant used was a conventional 10W40 multigrade lubricant and the additive concentration was 250 ppm by weight. The level of hydrocarbon emissions measured during the test, compared with the results obtained with the same fuel and untreated lubricating oil is detailed for each ester composition in Table 1.

EXAMPLE 5

The procedure of Example 4 was repeated using perfluoropolyether carboxylic acids of average molecular weight 1100 and 5000 rather than the "Galden" mono-acid. These were tested at 300 and 930 ppm respectively. Details of the resulting hydrocarbon emission values are given in Table 2.

EXAMPLE 6

The procedure of Example 4 was repeated using an alcohol in place of the poly(alkylene oxide) alcohol. Details of the alcohol and the resulting hydrocarbon emission values are given in Table 2.

EXAMPLE 7

To verify that the test method used as disclosed in Example 1a was a valid screening procedure for the novel type of additive described, full ECE 15.04+EUDC emissions tests were carried out on two catalyst vehicles with untreated and treated lubricating oils. The test was carried out on a composition prepared using Galden acid and $HO(CH_2CH_2O)_nCH_3$ where n is 16. The effect of this additive was a reduction in HC of 8% when tested using the base oil and additive concentration of Example 4. These tests were carried out a total of four times for each car/lubricant combination. One vehicle demonstrated an improvement of 4% in unburnt hydrocarbon whilst the other showed 8% improvement, thus confirming that the screening test used was valid. A small improvement (1%) in fuel economy was also observed. Test work has also shown that the additive reduces emissions from non-catalyst vehicles but by a smaller amount.

Comparative Test B

The procedure of Example 4 was repeated using $C_9F_{19}COOH$ rather than the "Galden" mono-acid and a poly(alkylene oxide) alcohol. Details of the poly(alkylene oxide) alcohol and the resulting hydrocarbon emission values are given in Table 2.

TABLE 1

| REACTANT | | REACTANT:ACID (mass ratio) | HYDROCARBON EMISSION (%) |
|---|---|---|---|
| $HO(CH_2CH_2O)_nCH_3$ | n = 7 | 0.44:1 | −5 |
| $HO(CH_2CH_2O)_nCH_3$ | n = 16 | 0.94:1 | −8 |
| $HO(CH_2CH_2O)_nCH_3$ | n = 45 | 2.00:1 | −8 |
| $HO(CH_2CH_2O)_nC_4H_9$ | n = 21 | 1.25:1 | −4 |
| $HO(CH_2CH_2O)_nC_4H_9$ | n = 30 | 1.80:1 | −1 |
| $HO(CH_2CH_2O)_nC_6H_5$ | n = 4 | 0.34:1 | −6 |
| $HO(CH_2CH(CH_3)O)_nC_4H_9$ | n = 22 | 1.71:1 | −4 |

TABLE 2

| REACTANT | | REACTANT:ACID (mass ratio) | HYDROCARBON EMISSION (%) |
|---|---|---|---|
| $HO(CH_2CH_2O)_nCH_3$ + A (Mol Wght = 1100) | n = 16 | 0.68:1 | −5 |
| $HO(CH_2CH_2O)_nCH_3$ + A (Mol Wght = 5000) | n = 16 | 0.15:1 | −1 |
| $HOC_8H_{17}$ | — | 0.16:1 | −3 |
| $HO(CH_2CH_2O)_nCH_3$ + $C_9F_{19}COOH$ | n = 16 | 0.46:1 | +9 |
| A = $F(CF(CF_3)CF_2O)_mCF(CF_3)COOH$ | | | |

The value of m can be calculated from the molecular weights of A.

We claim:

1. A lubricating oil composition for use in an internal combustion engine, said composition comprising:
   (1) a lubricating base oil, and
   (2) a monofunctionalized perfluoropolyether derivative of general formula $$R_F\text{-}Z$$

where $R_F$ is a perfluoropolyether moiety with average molecular weight in the range of from 135 to 20,000, and Z is a functional group, said perfluoropolyether derivative being present in the composition an amount from 50 to 5,000 ppm.

2. A lubricating oil according to claim 1 in which the perfluoropolyether moiety consists of a chain of perfluoroalkoxy groups terminated at one end with a perfluoroalkyl group.

3. A lubricating oil according to claim 2 wherein perfluoroalkyl group is $CF(CF_3)$.

4. A lubricating oil according to claim 2 wherein the perfluoroalkyl group is $CF_2$.

5. A lubricating oil according to claim 2 in which the perfluoroalkoxy groups are perfluoromethoxy, perfluoroethoxy, perfluoropropoxy or a combination thereof.

6. A lubricating oil according to claim 1 in which Z is a carboxylic acid, a carboxylate salt, an ester, an amide, a hydroxy, a hydroxy methyl, an alkoxy, an alkoxy methyl or a polvol ether functionality.

7. A lubricating oil according to claim 6 in which Z is an ester group.

8. A lubricating oil according to claim 7 wherein said monofunctionalized perfluoropolyether derivative in which Z is an ester is an ester of a monofunctional perfluoropolyether carboxylic acid and a hydroxy terminated monofunctional polyalkylene glycol.

* * * * *